US005459914A

United States Patent [19]

Bisping

[11] Patent Number: 5,459,914

[45] Date of Patent: Oct. 24, 1995

[54] METHOD OF SEALING THE FRONT OF A CYLINDRICAL SLEEVE BODY OF A PRACTICE CARTRIDGE

[75] Inventor: Bernhard Bisping, Ratingen, Germany

[73] Assignee: Rheinmetall GmbH, Rattingen, Germany

[21] Appl. No.: 305,692

[22] Filed: Sep. 13, 1994

[30] Foreign Application Priority Data

Sep. 13, 1993 [DE] Germany ..... 43 31 066.4

[51] Int. Cl.[6] ..... B21D 51/54

[52] U.S. Cl. ..... 29/1.3; 86/39; 102/444; 102/531

[58] Field of Search ..... 29/1.3, 1.31; 102/444, 102/446, 447, 530, 531; 86/39, 40, 41

[56] References Cited

U.S. PATENT DOCUMENTS

| | | | |
|---|---|---|---|
| 3,136,052 | 6/1964 | Pickart | 102/530 |
| 3,628,225 | 12/1971 | Parker | 29/1.3 |
| 4,162,645 | 7/1979 | Abbott | 86/23 |
| 4,867,065 | 9/1989 | Kaltmann | 102/444 |

FOREIGN PATENT DOCUMENTS

| | | | |
|---|---|---|---|
| 749143 | 12/1966 | Canada | 102/531 |
| 1082162 | 5/1960 | Germany | 102/530 |
| 3048599 | 7/1982 | Germany | 102/444 |
| 4128050 | 2/1993 | Germany | 102/444 |
| 1138341 | 2/1993 | Germany | 102/444 |
| 277762 | 9/1927 | United Kingdom | 102/530 |
| 648923 | 3/1948 | United Kingdom . | |
| 967462 | 2/1961 | United Kingdom . | |

*Primary Examiner*—Harold J. Tudor
*Attorney, Agent, or Firm*—Spencer, Frank & Schneider

[57] ABSTRACT

A method of closing the forward portion or region (u) of a cylindrical sleeve body (3) of a practice cartridge (1), wherein a predetermined number of inside and outside radial folds (8, 7, respectively) are created in the forward region (4) of the sleeve body (3) in two work cycles, and wherein circular arc-shaped inside folds (8) of predetermined depth are created during the first work cycle by the application of radial pressure using correspondingly shaped profiling tools. To achieve secure closing of the sleeve body (3) through folding in a simple and cost-effective manner and without predetermined fracture points resulting in the region of the inside folds (8) during closing, the inside folds (8) are created in the forward region of the projectile body (3) during the first work cycle so that a first, central opening having a diameter of at least 2 mm remains between the inside folds (8) after completion of this work cycle. Due to this first step, tools that have a relatively large bending radius can be used for creating the inside folds, despite the high number of folds. In the subsequent second work cycle, a further radial pressing together of the inside folds (8) is effected by exerting pressure on the outside folds (7), e.g. by using a conical die.

13 Claims, 2 Drawing Sheets

METHOD OF SEALING THE FRONT OF A CYLINDRICAL SLEEVE BODY OF A PRACTICE CARTRIDGE

BACKGROUND OF THE INVENTION

The invention relates to a method of sealing the front cylindrical portion of a sleeve body of a practice cartridge wherein a predetermined number of radial inside and outside folds are created in the forward region of the sleeve body in two work cycles, and wherein circular arc-shaped inside folds of a predetermined radial depth are created during the first work cycle by exerting radial pressure on an outer surface of the cylindrical sleeve body using corresponding shaped profiling tools.

Practice cartridges in which the forward region of the sleeve body, which as a rule has the shape of a projectile bursting body, are closed by folding are known from numerous patent documents (e.g. British Reference No. GB 277, 762, and German Reference Nos. DE 1,138,341, DE 1,082, 162 and DE-OS 4,128,050). In these cases, the folding is typically effected in a single work cycle, in which the cylindrical tip or forward section or region of the sleeve body is pressed in at, for example, six locations at the circumference by radially inwardly-closing profiling stamps or tools until the inside folds being formed touch lightly in the interior. The opening that may remain between the inside folds can then be sealed subsequently by the application of a water-insoluble varnish.

Practical experiments have shown that a method of this type leads to poor firing results, because with a large number of folds the width of the profiling stamp must be relatively narrow. However, such a narrow stamp results in the region of the inside folds being subjected to a severe material stress and, possibly, even crack formation. If, on the other hand, the profiling stamps are configured to be wider and to have a preferably arc-shaped profile, a relatively large opening remains between the inside folds, and sealing this opening by means of a varnish gives rise to problems.

A method in which the sleeve body is closed by fold formation in two work cycles is further known from German published patent application No. DE-AS 1,159,379. In the first work cycle, a relatively small number of circular arc-shaped inside folds are created and brought into contact with one another. In the subsequent, second work cycle, the outside folds, by means of an ogival, concave die and the application of an axial pressure, are flattened, are broadened laterally and are pressed together in such a way that two lateral folds describing part of a circular arc in cross-section are formed from each outside fold, with these lateral folds tapering toward the end, and together forming an ogive.

Aside from the fact that this method is relatively expensive, it has the disadvantage that slight partial deformations can occur during production that have a negative influence on the function of the training cartridge and can lead to jamming in the weapon barrel. In particular, the division of the outside folds into lateral folds is associated with considerable problems.

It is therefore the object of the invention to disclose a method of the type mentioned at the outset which permits a simple and thus cost-effective way of closing or sealing the cartridge body, and in particular the front region of the cylindrical sleeve body by folding without resulting in predetermined fracture points in the region of the inside folds during closing or sealing.

SUMMARY OF THE INVENTION

The above object is accomplished generally in accordance with the invention by a method of sealing a forward region of a cylindrical sleeve body of a practice cartridge by forming a predetermined number of radial inside and outside folds in the forward region of the dummy projectile body, which method comprises forming the folds by:

creating circular arc-shaped inside folds of a predetermined radial depth during a first work cycle by exerting radial pressure on an outer surface of the cylindrical sleeve body using correspondingly shaped profiling tools, with the radial depth of the inside folds being such that an opening having a diameter of at least 2 mm remains in the center between the inside folds; and, in a second following work cycle, pressing the forward region of the sleeve body further together in the radial direction by exerting pressure in the radial direction on the outside folds without a significant broadening of the outside folds.

The invention is essentially based on the concept of creating inside folds in the forward region of the cartridge body during the first work cycle. However, these folds do not touch, as is the case in German reference DE-AS 1,159,379. Rather, a central opening having a diameter of at least 2 mm, preferably approximately 3 to 4 mm, remains in the interior of the sleeve body between the folds after their closing or initial folding. Thus, it is accomplished that, despite the higher number of folds, the tools can still have pistons that have a relatively large bending radius for producing the inside folds. In the second work cycle a further radial pressing together of the inside folds is effected by means of pressure on the outside folds, e.g. by means of a conical die.

In the second work cycle, the pressure on the outside folds can be selected such that the sleeve body is completely closed in its forward region without crack formation taking place in the region of the inside folds. However, experiments have shown that in such complete closing by folding, partial deformations can occur in the forward region, which then in turn have a negative influence on the firing results.

Consequently, it has proven advantageous, according to a preferred modification of the invention, to select the pressure on the outside folds such that, after the second work cycle, a small opening having a diameter larger than 0.5 mm, preferably approximately 1 mm, remains between the inside folds, and this opening can be sealed to be watertight with varnish without problems.

According to further features of the invention, the radial depth of the inside folds at the end of the first work cycle is such that the opening in the center has a diameter of 3 to 4 mm, six inside folds and six outside folds are created in the forward region of the sleeve body, and the exerting of radial pressure on the outside folds is effected by providing a die having a conical interior bore which extends in the longitudinal directional of its conical interior, and pressing the die over the forward region of the sleeve body in the longitudinal direction of the sleeve body. Moreover, preferably the sleeve body is formed of steel of the type ST 35 NBK according to DIN 2391 having a strength $R_m$<420 N/mm$^2$.

According to features of the above mentioned preferred modification of the method according to the invention, the pressing during the second work cycle is such that any openings that remain within the folds themselves have a maximum width of 0.4 mm in the circumferential direction.

Further details about and advantages of the invention ensue from the embodiments described below with reference to the drawing figures.

DETAILED DESCRIPTION OF THE PREFERRED EMBODIMENT

Figure 1:
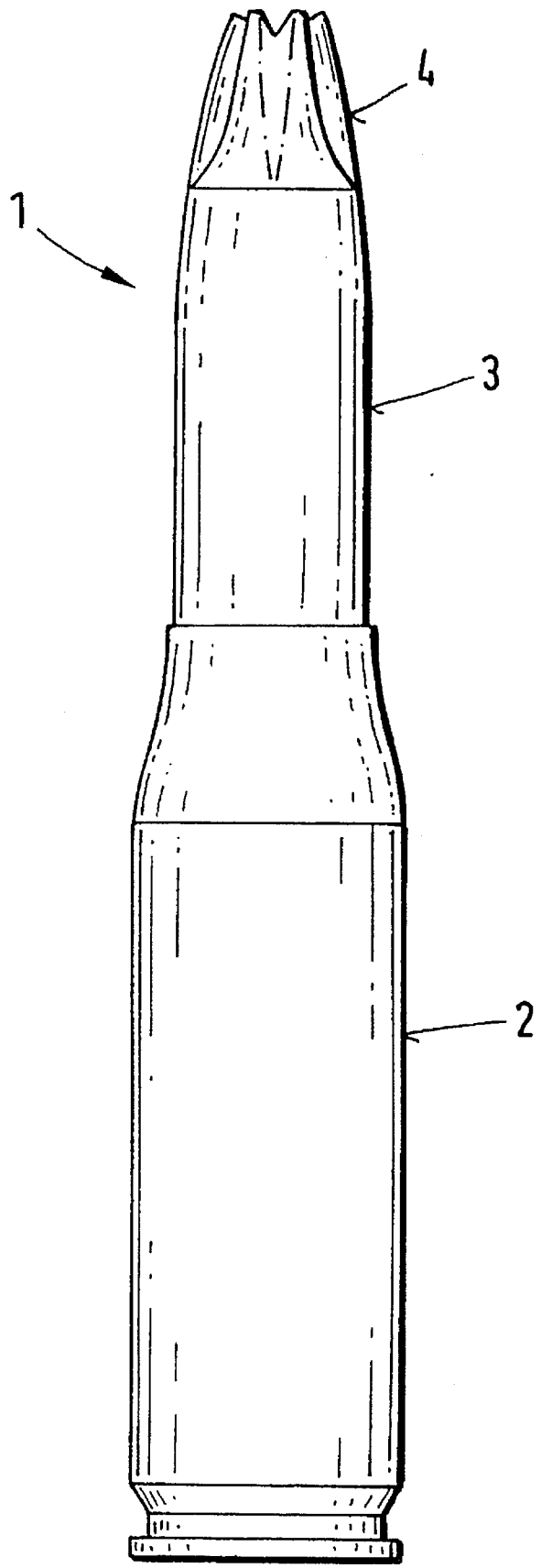
FIG. 1 is a side view of a practice cartridge having a sleeve body whose front or forward region has been closed or sealed by the method according to the invention.
Figure 4:
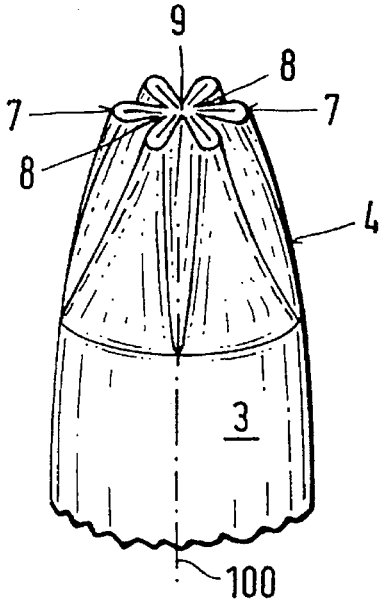

FIG. 1, shows a two-part practice cartridge 1 for use in machine guns. The cartridge 1 essentially comprises a cartridge case 2 filled with powder and a sleeve body 3 secured to the front of the cartridge case 2 and configured as a bursting body or dummy projectile. The forward region 4 of sleeve body 3 is closed by folding, and has six inside folds 8 and six outside folds 7 as can be seen in FIG. 4.

Figure 2:
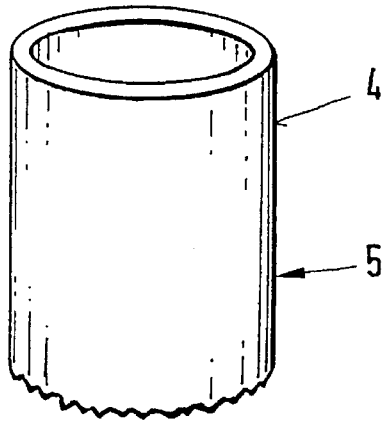
FIGS. 2 through 4 are views in perspective of the forward region of the sleeve body of the practice cartridge shown in FIG. 1 during the folding process according to the invention.

The method according to the invention of closing or sealing projectile body 3 is described in detail below with reference to FIGS. 2–4.

Seamless precision tubes 5 (FIG. 2) of corresponding length and made of steel (ST 35 NBK according to DIN 2391) having a strength $R_m$<420 N/mm$^2$ have proven particularly effective as a starting material for sleeve body 3. As experiments have shown, other steel tubes, particularly those having a strength $R_m$>420 N/mm$^2$, tend to form cracks during folding, so that an additional annealing process may be necessary prior to or following folding.

Figure 3:
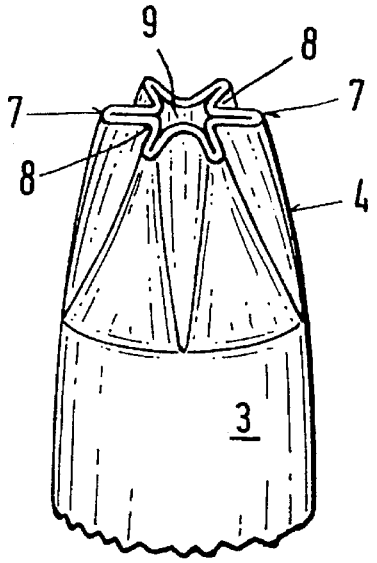

After the respective steel tube 5 has been lengthened, its forward region (folding region) 4 is processed (see also FIG. 1) in that metal is removed, and the wall thickness in folding region 4 is selected to correspond to the predetermined obduration (e.g. 0.8 mm). The actual folding then takes place in two work cycles:

In the first work cycle, folding region 4 is pressed radially in at six locations at the circumference (6 * 60° division) by radially inwardly-closing profiling stamps or tools that have an arc-shaped profile, resulting in the outside or inside radial folds indicated by 7 and 8, respectively, in FIG. 3. In this process the profiling stamps or tools are pressed in, preferably symmetrically, so far that an opening 9 having a diameter of approximately 3 to 4 mm remains between inside folds 8 in the center of the front or folding region 4 of the projectile body 3.

During the subsequent second work cycle, folding region 4 is further pressed together by the exertion of radial pressure on the outside folds 7 to form a closure. For this purpose, a die is used which has a bore (conical die) that tapers in the direction of the longitudinal axis 100 of the die and/or the body 3. By movement of the die in the direction of the longitudinal axis body 3, pressure is exerted in a radial direction on outside folds 7 until central opening 9, which results between inside folds 8, has a diameter of approximately 1 mm. Any openings that may remain within respective folds 7 and 8 themselves should have a maximum width of 0.4 mm in the circumferential direction.

Opening 9 and any openings possibly remaining within folds 7 and 8 are subsequently sealed to be watertight in a known manner with a varnish.

Of course, the invention is not limited to the described embodiment. For example, it is also possible to use the method to produce one-piece practice cartridges in which cartridge case and sleeve body consist of the same metal piece. The method can be used both for the production of automatic ammunition and ammunition for small arms or hand guns. Finally, the method is also not limited to the described number of six folds, but also permits closure of the projectile body with a different number of folds, for example, three, five, seven or eight folds.

An essential advantage of the invention is also that, when the folds open during firing, no longitudinal cracks occur on the inside and outside folds. As a result, differences in gas pressure buildup and in the maximum gas pressures are reduced to a minimum from shot to shot. This assures uniform functioning of the weapon.

Moreover, with the method of the invention, dangerous metal particles are prevented from detaching in the region of folds 7, 8 when the folds open during firing. This results in maximum safety with regard to the operating personnel.

The invention now being fully described, it will be apparent to one of ordinary skill in the art that any changes and modifications can be made thereto without departing from the spirit or scope of the invention as set forth herein.

What is claimed is:

1. A method of sealing a forward region of a forward cylindrical sleeve body of a practice cartridge by forming a closure comprising a predetermined number of radial inside and outside folds in a forward region of the sleeve body, said method comprising forming the folds by creating circular arc-shaped inside folds of a predetermined radial depth during a first work cycle by exerting radial pressure on an outer surface of the cylindrical sleeve body using correspondingly shaped profiling tools, with the radial depth of the inside folds being such that an opening having a diameter of at least 2 mm remains in the center between the inside folds, and, in a following second work cycle, pressing the forward region of the sleeve body further together in the radial direction to reduce said center opening by exerting pressure in the radial direction on the outside folds while avoiding a significant broadening of the outside folds to form said closure; and, subsequently applying a water tight varnish to said forward region of said sleeve body to seal said opening and said sleeve body.

2. The method defined in claim 1, wherein in the first work cycle, the radial depth of the inside folds is such that the opening in the center has a diameter of 3 to 4 mm.

3. The method defined in claim 1, wherein six inside folds and six outside folds are created in the forward region of the sleeve body.

4. The method defined in claim 1, wherein exerting of radial pressure on the outside folds is effected by providing a die having a conical interior bore which extends in the longitudinal directional of its conical interior, and pressing the die over the forward region of the sleeve body in the longitudinal direction of the sleeve body.

5. The method defined in claim 1, wherein the sleeve body is formed of ST 35 NBK steel according to DIN 2391 having a strength $R_m$<420 N/m$^2$.

6. A method for sealing a forward region of a cylindrical sleeve body of a practice cartridge by forming a closure comprising a predetermined number of radial inside and outside folds in the forward region of the sleeve body, said method comprising:

forming the predeterminable number of radial inside and outside folds in the forward region by (a) creating circular arc-shaped inside folds of a predetermined depth during a first work cycle by exerting radial pressure on an outer surface of the sleeve body in said forward region using correspondingly shaped profiling tools, with the depth of the inside folds being such that an opening having a diameter of at least 2 mm remains in the center of the forward region between the inside folds, and (b) in a second work cycle, pressing the forward region of the sleeve body further together in the radial direction by exerting pressure in the radial direction on the outside folds while avoiding significant broadening of the outside folds until the opening formed between the inside folds still has a diameter of at least 0.5 mm to form the closure; and, subsequently water tight sealing the opening with varnish.

7. The method defined in claim 6, wherein in the first work cycle, the radial depth of the inside folds is such that the opening in the center has a diameter of 3 to 4 mm.

8. The method defined in claim 6, wherein, during the second work cycle, the forward region of the sleeve body is pressed together by radial pressure such that an opening having a diameter of approximately 1 mm remains.

9. The method defined in claim 8, wherein the pressing during the second work cycle is such that any opening remaining within the folds has a maximum width in the circumferential direction of 0.4 mm.

10. The method defined in claim 9, wherein in the first work cycle, the radial depth of the inside folds is such that the opening in the center has a diameter of 3 to 4 mm.

11. The method defined in claim 8, wherein six inside folds and six outside folds are created in the forward region of the sleeve body.

12. The method defined in claim 6, wherein exerting of radial pressure on the outside folds is effected by providing a die having a conical interior bore which extends in the longitudinal directional of the conical interior, and pressing the die over the forward region of the sleeve body in the longitudinal direction of the sleeve body.

13. The method defined in claim 6, wherein the sleeve body is formed of ST 35 NBK steel according to DIN 2391 having a strength $R_m$<420 N/mm$^2$.

* * * * *